US008910320B2

(12) United States Patent
Stauber et al.

(10) Patent No.: US 8,910,320 B2
(45) Date of Patent: Dec. 16, 2014

(54) AUTOMATED SEAT AND/OR LID ASSEMBLY FOR A TOILET

(71) Applicant: Kohler Co., Kohler, WI (US)

(72) Inventors: Joseph L. Stauber, Sheboygan Falls, WI (US); Erich C. Vierkant, III, Sheyboygan, WI (US); Brian M. Kaule, Sheyboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 14/053,427

(22) Filed: Oct. 14, 2013

(65) Prior Publication Data

US 2014/0047629 A1 Feb. 20, 2014

Related U.S. Application Data

(63) Continuation of application No. 12/099,509, filed on Apr. 8, 2008, now Pat. No. 8,555,427.

(60) Provisional application No. 60/915,021, filed on Apr. 30, 2007.

(51) Int. Cl.
*A47K 13/10* (2006.01)
*A47K 13/30* (2006.01)

(52) U.S. Cl.
CPC ..... *A47K 13/10* (2013.01); *A47K 13/305* (2013.01)
USPC ..... 4/246.1; 4/236; 4/240

(58) Field of Classification Search
USPC ..... 4/236, 240, 246.1
See application file for complete search history.

(56) References Cited

U.S. PATENT DOCUMENTS

| | | | |
|---|---|---|---|
| 538,168 | A | 4/1895 | Keeler |
| 1,529,656 | A | 3/1925 | Kornhauser |
| 2,181,017 | A | 11/1939 | Hill |
| 3,060,458 | A | 10/1962 | Burke |
| 3,925,833 | A | 12/1975 | Hunter |
| 4,055,864 | A | 11/1977 | Liu et al. |

(Continued)

FOREIGN PATENT DOCUMENTS

| | | |
|---|---|---|
| DE | 3143724 | 5/1983 |
| DE | 4417827 | 11/1995 |

(Continued)

OTHER PUBLICATIONS

International Search Report and Written Opinion for PCT/US2008/004607 dated Jul. 14, 2008.

(Continued)

*Primary Examiner* — Basil Katcheves
*Assistant Examiner* — Joshua Ihezie
(74) *Attorney, Agent, or Firm* — Foley & Lardner LLP

(57) ABSTRACT

The present invention is an automated seat and/or lid assembly for a toilet. The invention includes switch automation, wherein movement of a bowl attachment is initiated via a switch, and manual-urging automation, wherein movement of a bowl attachment is initiated via manual urging by a user. An automated attachment assembly may be configured to provide both switch and manual-urging automation concomitantly based upon predetermined logic. Furthermore, the invention includes a method of identifying manual movement and of assisting the movement of a bowl attachment. The invention further includes an object sensor incorporated within the seat or lid to detect the presence or absence of an object near the bowl attachment.

20 Claims, 10 Drawing Sheets

(56) References Cited

U.S. PATENT DOCUMENTS

| | | | | | |
|---|---|---|---|---|---|
| 4,091,473 | A | | 5/1978 | Matthews et al. | |
| 4,150,446 | A | | 4/1979 | Crocker | |
| 4,168,552 | A | | 9/1979 | Austin | |
| 4,438,535 | A | | 3/1984 | Paredes | |
| 4,446,584 | A | * | 5/1984 | Suzuki et al. | 4/237 |
| 4,551,866 | A | * | 11/1985 | Hibbs | 4/246.1 |
| 4,780,914 | A | * | 11/1988 | Lin | 4/236 |
| 4,995,120 | A | * | 2/1991 | Tager | 4/246.1 |
| 5,010,601 | A | * | 4/1991 | Kobayashi et al. | 4/236 |
| 5,167,039 | A | | 12/1992 | Sim | |
| 5,279,000 | A | * | 1/1994 | Mercier et al. | 4/240 |
| 5,307,524 | A | * | 5/1994 | Veal | 4/246.1 |
| 5,311,619 | A | * | 5/1994 | Ward | 4/246.1 |
| 5,341,518 | A | * | 8/1994 | Uhl | 4/236 |
| 5,353,443 | A | | 10/1994 | Sim | |
| 5,371,906 | A | | 12/1994 | Tzang | |
| 5,388,281 | A | * | 2/1995 | Wiklund et al. | 4/248 |
| 5,400,442 | A | * | 3/1995 | Pendlebury | 4/246.2 |
| 5,444,877 | A | | 8/1995 | Kumarasurier | |
| 5,592,700 | A | | 1/1997 | Genesse | |
| 5,592,703 | A | | 1/1997 | Jones et al. | |
| 5,603,127 | A | | 2/1997 | Veal | |
| 5,625,294 | A | * | 4/1997 | Kawai et al. | 324/668 |
| 5,666,672 | A | | 9/1997 | Birsel et al. | |
| 5,715,543 | A | | 2/1998 | Sim | |
| 5,794,277 | A | * | 8/1998 | Jones | 4/236 |
| 5,819,325 | A | | 10/1998 | Richards | |
| 5,878,444 | A | | 3/1999 | Convoy | |
| 5,901,384 | A | * | 5/1999 | Sim | 4/313 |
| 5,978,974 | A | | 11/1999 | Mullen | |
| 6,003,159 | A | | 12/1999 | Sadegh et al. | |
| 6,067,667 | A | * | 5/2000 | Suzuki | 4/246.1 |
| 6,112,335 | A | | 9/2000 | Gaston | |
| 6,226,804 | B1 | * | 5/2001 | Ballard | 4/246.1 |
| 6,321,393 | B1 | * | 11/2001 | Jones | 4/246.1 |
| 6,539,557 | B1 | * | 4/2003 | Avila | 4/240 |
| 6,643,852 | B1 | * | 11/2003 | Lin | 4/246.1 |
| 6,775,854 | B2 | * | 8/2004 | Nishikawa et al. | 4/246.1 |
| 6,792,626 | B1 | * | 9/2004 | Smeal et al. | 4/246.1 |
| 6,915,532 | B1 | * | 7/2005 | Mohammed | 4/246.1 |
| 6,968,579 | B1 | * | 11/2005 | Feinberg et al. | 4/246.1 |
| 7,036,158 | B2 | | 5/2006 | Bradford et al. | |
| 7,161,118 | B1 | * | 1/2007 | Modeste et al. | 219/217 |
| 7,171,700 | B2 | | 2/2007 | Glew | |
| 7,293,297 | B2 | * | 11/2007 | Hayashi et al. | 4/246.1 |
| 7,562,399 | B2 | * | 7/2009 | Parsons et al. | 4/323 |
| 7,917,973 | B2 | * | 4/2011 | Baumoel | 4/246.1 |
| 8,336,126 | B2 | * | 12/2012 | Baumoel | 4/246.1 |
| 2002/0024344 | A1 | * | 2/2002 | Kato et al. | 324/662 |
| 2002/0162166 | A1 | * | 11/2002 | Saar et al. | 4/302 |
| 2003/0154541 | A1 | * | 8/2003 | Miller | 4/246.1 |
| 2004/0060104 | A1 | * | 4/2004 | Nishikawa et al. | 4/246.1 |
| 2004/0078880 | A1 | * | 4/2004 | Hewton | 4/246.1 |
| 2005/0015871 | A1 | * | 1/2005 | Tomita et al. | 4/425 |
| 2005/0133754 | A1 | * | 6/2005 | Parsons et al. | 251/129.17 |
| 2005/0217010 | A1 | * | 10/2005 | Hayashi et al. | 4/246.1 |
| 2006/0031981 | A1 | * | 2/2006 | Thompson | 4/246.1 |
| 2006/0041997 | A1 | | 3/2006 | Kist et al. | |
| 2006/0090252 | A1 | | 5/2006 | Pantos et al. | |
| 2006/0242755 | A1 | * | 11/2006 | Lohss | 4/246.1 |
| 2007/0033721 | A1 | | 2/2007 | Creswick et al. | |
| 2007/0056084 | A1 | * | 3/2007 | Watt et al. | 4/246.1 |
| 2007/0056085 | A1 | | 3/2007 | Dyson et al. | |
| 2008/0083056 | A1 | * | 4/2008 | Damianoe et al. | 4/213 |
| 2008/0083057 | A1 | * | 4/2008 | Jung et al. | 4/246.1 |
| 2008/0141444 | A1 | | 6/2008 | Lin | |
| 2008/0224880 | A1 | * | 9/2008 | Valentine | 340/686.6 |
| 2009/0235441 | A1 | * | 9/2009 | Spadola et al. | 4/213 |
| 2010/0101009 | A1 | * | 4/2010 | Hsiao | 4/246.1 |
| 2010/0115688 | A1 | * | 5/2010 | Mauduit | 4/246.1 |
| 2010/0306910 | A1 | * | 12/2010 | Chen | 4/246.1 |
| 2010/0313343 | A1 | * | 12/2010 | Kang et al. | 4/246.1 |
| 2011/0056005 | A1 | * | 3/2011 | Baumoel | 4/246.1 |
| 2011/0145985 | A1 | * | 6/2011 | Lin | 4/246.1 |
| 2011/0277228 | A1 | * | 11/2011 | Corbell et al. | 4/246.1 |
| 2011/0302708 | A1 | * | 12/2011 | Parsons et al. | 4/313 |
| 2012/0167292 | A1 | * | 7/2012 | Baumoel | 4/246.1 |

FOREIGN PATENT DOCUMENTS

| | | |
|---|---|---|
| DE | 10311132 | 9/2004 |
| WO | 2004/100745 | 11/2004 |
| WO | WO-2004/100745 | 11/2004 |
| WO | 2008/004607 | 10/2008 |

OTHER PUBLICATIONS www.Kohler.com, K-4649, Heated French Curve Toilet Seat.

* cited by examiner

AUTOMATED SEAT AND/OR LID ASSEMBLY FOR A TOILET

CROSS-REFERENCE TO RELATED APPLICATIONS

This application is a Continuation of U.S. patent application Ser. No. 12/099,509, filed Apr. 8, 2008 (now U.S. Pat. No. 8,555,427), which claims priority to and the benefit of U.S. provisional application No. 60/915,021 filed Apr. 30, 2007, both of which are hereby incorporated by reference as if fully set forth herein.

STATEMENT OF FEDERALLY SPONSORED RESEARCH OR DEVELOPMENT

Not applicable.

BACKGROUND OF THE INVENTION

The present invention relates to an automated seat and/or lid assembly for a toilet. More particularly, it relates to the electronic control of seat and/or lid positioning relative to the bowl.

The typical toilet includes a pair of bowl attachments, namely a seat and a lid, which can be raised and lowered over the toilet bowl. Raising and lowering the seat and/or lid presents a challenge for many. Certain disabilities make the task of lifting the lid of a toilet difficult to accomplish. For example, where one is confined to a wheelchair raising and lowering the lid can be problematic when there is insufficient space around the toilet to allow easy wheelchair access. Many other circumstances and disabilities, such as having arthritis of the hands, arms, or back, impede a person's ability to easily and comfortably alter the position of the seat and lid of a typical toilet. For able-body persons, changing the position of the seat and lid is often perceived as an unsanitary inconvenience.

To address this, some devices incorporate a foot pedal to raise the lid of a toilet. While this may eliminate the need to use arms or hands, the technique requires that a person balance on one foot while applying a downward force with the other.

Other devices incorporate detectors to sense when a person is approaching or leaving the toilet. This approach may have difficulty accommodating persons in wheel chairs and children due to the placement and/or calibration of the detectors. Furthermore, the detectors are susceptible to erroneous signals as they may become obstructed by any one of the numerous items commonly found in a bathroom.

Still others have incorporated buttons that are linked to a means of automating the bowl attachment; however, the buttons are typically located on the periphery of the toilet bowl or rear deck. As a result, it can be difficult or inconvenient to reach the buttons.

Lastly, erroneous activation is a concern when the operation of the bowl attachment is automated. If the bowl attachment is activated while a person or object is on the seat and/or lid, the person may be startled, the object broken, or the automation hardware damaged. Many of the current detectors require line-of-sight to detect the presence of an object near the toilet. As a result, the detectors may become obstructed leading to erratic operation or an object may be out of the detectors line-of-sight yet still obstruct the bowl attachment.

A need thus exists for an automated attachment assembly for a toilet providing a sanitary, safe system for raising and lowering the seat and/or lid.

SUMMARY OF THE INVENTION

The present invention is an automated attachment assembly, such as a seat and/or lid, for a toilet. The invention includes switch automation (i.e., wherein movement of a bowl attachment is initiated via a switch) and manual-urging automation (i.e., wherein movement of a bowl attachment is initiated via manual urging by the user). An automated attachment assembly in accordance with the present invention may be configured to provide both switch and manual-urging automation concomitantly. Furthermore, the invention includes a method of identifying manual movement of a bowl attachment and of assisting the movement of the bowl attachment. Lastly, the invention includes an object sensor incorporated with a bowl attachment to detect the presence or absence of an object near the bowl attachment.

In one aspect, the invention provides an automated attachment assembly for a toilet, comprising a bowl attachment that is pivotable between a first position and a second position, a switch mounted to the bowl attachment, and an actuator that may be activated by the switch to pivot the bowl attachment between the first and second positions.

In another aspect the invention provides an automated cover assembly for a toilet, comprising a seat and lid assembly that is pivotally mounted with respect to one another to be moveable into three configurations; namely, a first configuration in which the seat and the lid are lowered, a second configuration in which the seat is lowered and the lid is raised, and a third configuration in which the seat and lid are raised. A switch is mounted to the seat, the lid, or both. Also, an actuator is activated by the switch and coupled to the seat and lid assembly for selectively moving the seat and lid assembly into the first, second, and third configurations.

In still another aspect the invention provides a power assisted attachment assembly for a toilet, comprising a bowl attachment being pivotable between a first position and a second position, and an actuator operationally coupled to the bowl attachment to pivot the bowl attachment between the first and second positions. The actuator pivots the bowl attachment toward the first position or second position in response to a manual urging by a user to the bowl attachment toward the first position or second position respectively.

In yet a further aspect, the invention provides an automated cover for a toilet, comprising a seat and lid assembly pivotally mounted with respect to one another to be moveable into three configurations, a first configuration in which the seat and the lid are lowered, a second configuration in which the seat is lowered and the lid is raised, and a third configuration in which the seat and lid are raised. An actuator is coupled to the seat and lid assembly for selectively moving the seat and lid assembly into the first, second, and third configurations in response to a manual urging by a user to the seat and/or the lid.

In another aspect, the invention provides a method of moving a bowl attachment from a first position to a second position, comprising the steps of identifying manual movement of the bowl attachment from the first to the second position and assisting movement of the bowl assembly from the first to the second position.

In yet a further aspect, the invention provides an object sensor for a toilet, comprising a bowl attachment that is pivotable between a first position and a second position, and a capacitive sensor coupled to the bowl attachment for sensing the presence of an object adjacent to the bowl attachment.

These and other advantages of the invention will be apparent from the detailed description and drawings. What follows are one or more example embodiments of the present invention. To assess the full scope of the invention the claims should be looked to, as the example embodiments are not intended as the only embodiments within the scope of the invention.

DETAILED DESCRIPTION OF THE EXAMPLE EMBODIMENTS

The present invention includes an automated attachment assembly for a toilet. While the example embodiment describes a toilet comprising multiple bowl attachments (e.g., a lid and a seat), other combinations are within the scope of the invention. For example, the "seat" may be integral with the bowl, the lid may be excluded, and the like. The invention is compatible with various shapes and sizes of toilet bowls and bowl attachments. Additionally, the toilet of the example embodiment is a tank-less, pump powered flush toilet, however, the invention is equally applicable to tank toilets, valve toilets, and the like.

Figure 1:
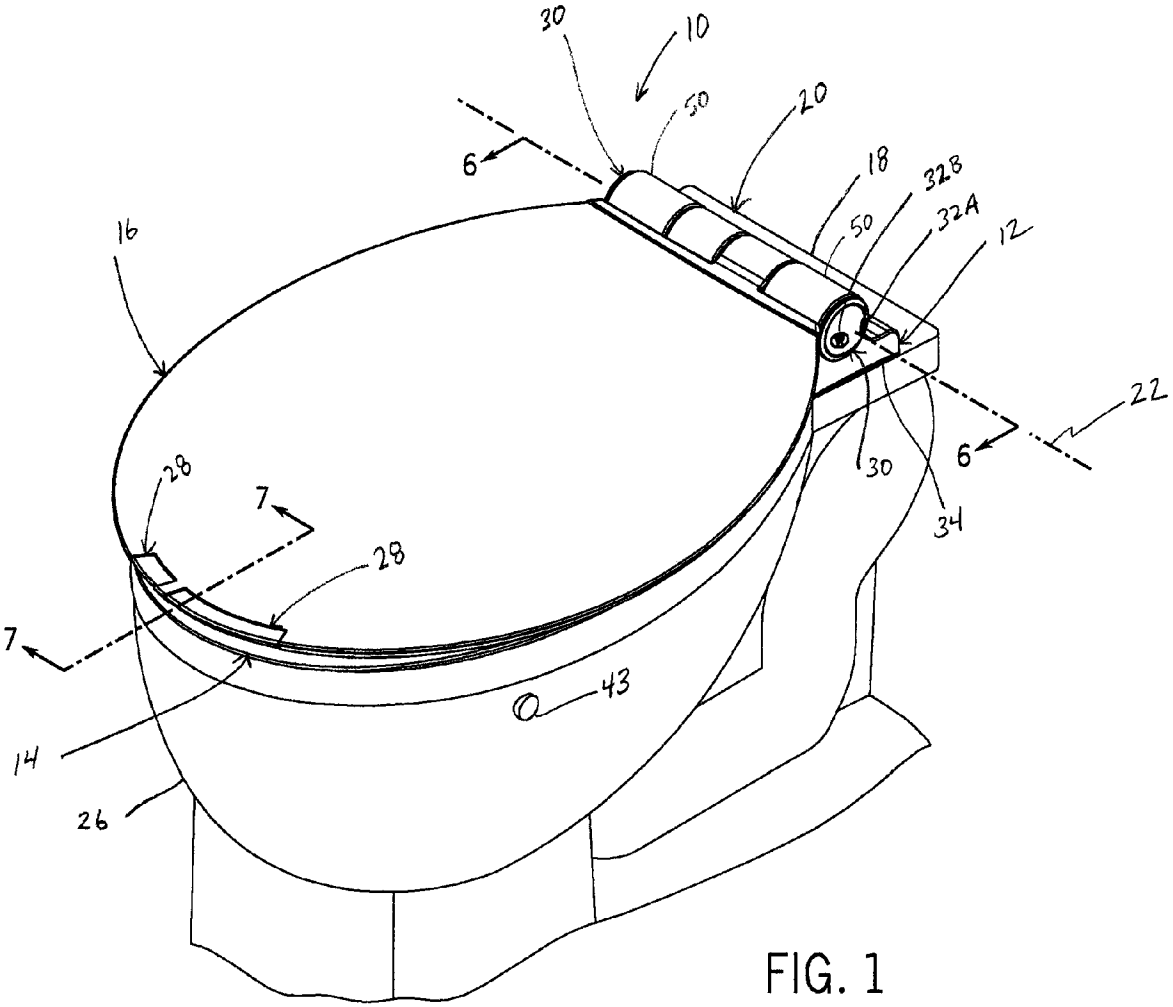
FIG. 1 is a perspective view of an attachment assembly coupled to a toilet in accordance with an example embodiment.

Referring now to the drawings, FIG. 1 shows an attachment assembly 10 comprising a base assembly 12 and two bowl attachments, namely a seat 14 and a lid 16. The seat 14 and lid 16 are pivotally coupled to the base assembly 12 at a back deck 18 of a toilet 20 by fasteners (not shown). Alternatively, the base assembly 12 may be formed integrally with the toilet 20. The seat 14 and lid 16 are each pivotable about a hinge axis 22 between a closed or lowered position (shown in FIG. 1) and an open or raised position (shown in FIG. 2). The seat 14 and lid 16 may be configured such that the lid 16 is in a raised position while the seat 14 is in a closed position (shown in FIG. 3), thus allowing access to an opening 24 defined by the toilet bowl 26 and/or seat 14.

A pair of switch assemblies 28 provide an input for actuating the pivotal movement of the seat 14 and lid 16 when the attachment assembly 10 is configured for switch automation. A single switch assembly 28 may be used, however, a pair of switch assemblies 28 is preferable to provide additional control during switch automation as will be described in detail below. The switch assemblies 28 are preferably mounted to the lid 16 at a portion opposite the base assembly 12, however, one or more switch assemblies 28 may be mounted to the seat 14, or any portion of the bowl attachments. Mounting the switch assemblies 28 to the front of the lid 16, near the distal end of the bowl attachment, provides convenient, sanitary access to the switch assemblies 28. It is of note that switch assemblies 28 may not be present when the attachment assembly 10 is configured for manual-urging automation (i.e., to pivot the bowl attachments in response to a manual urging from a user); however, the switch automation and manual-urging automation are preferably configured to operate concomitantly.

A pair of option selection switch assemblies 30 are located along the hinge axis 22 at the ends of the base assembly 12. In the example embodiment, each option selection switch assembly 30 includes a pair of selection switches 32. The selection switches 32 may control such functions as activating and deactivating a bowl light, bowl attachment automation, bowl attachment heating, object sensing, and courtesy flushing. In the example embodiment, the selection switches 32 include an automatic flush switch 32A to toggle the automatic flushing feature that flushes the toilet 20 upon closing the seat 14 and the lid 16, a bowl light switch 32B to toggle on and off a bowl light (not shown), an automated attachment switch 32C to toggle on and off the bowl attachment opening and closing assistance/automation, and a bowl attachment heater switch 32D to cycle through the various levels of heating available.

The selection switches 32 may include illuminated feedback. For example, the selection switches 32 may be illumined green when active and red when inactive, or change from yellow to orange to red as the level of heating is increased. Lastly, the option selection switch assemblies 30 may be mounted directly to the bowl attachments, e.g., the seat 14 and the lid 16, but are preferably mounted to the base assembly 12 to prevent accidental switching.

Figure 4:
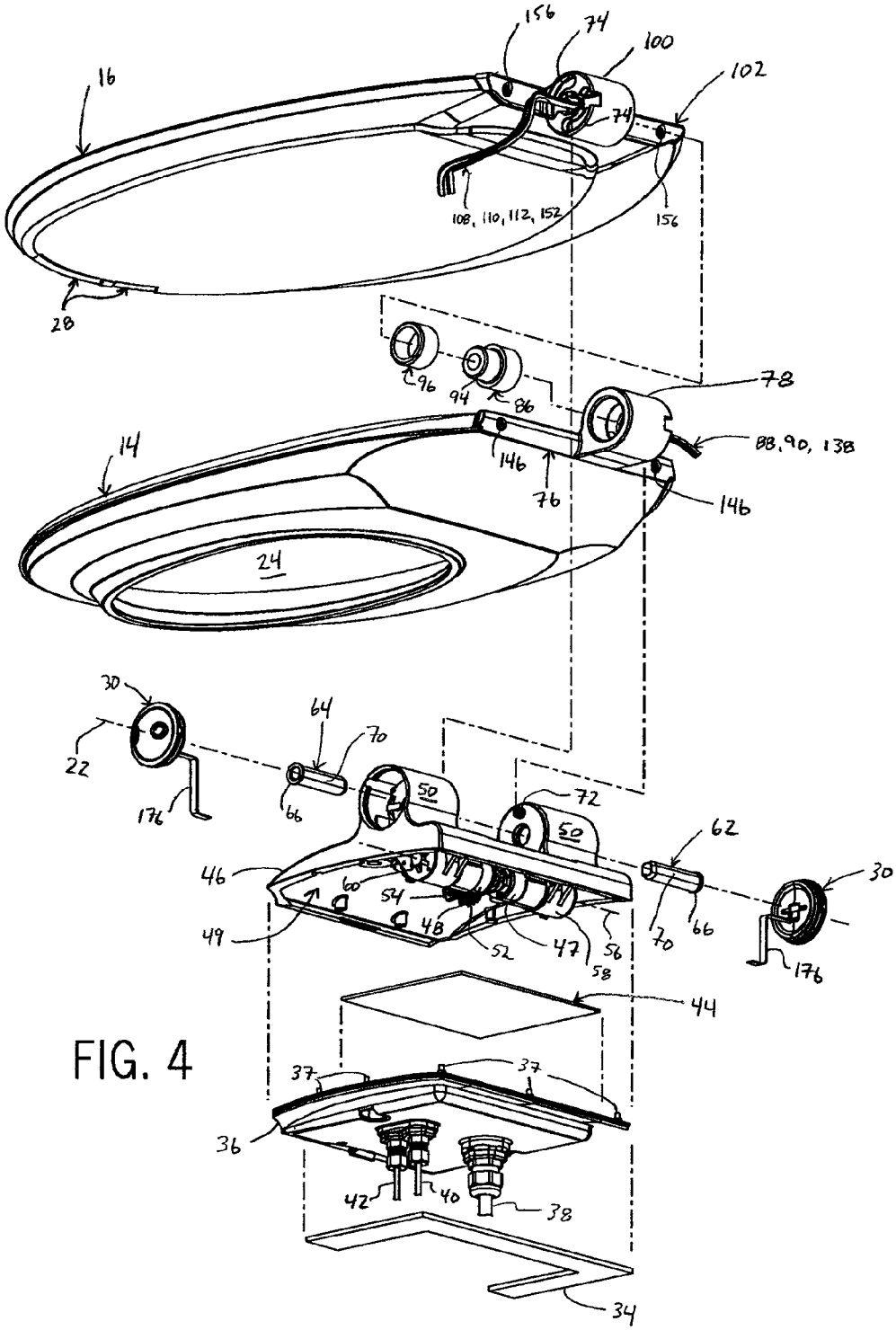
FIG. 4 is an exploded, perspective view of the attachment assembly.

An exploded view of the main components of the attachment assembly 10 is shown in FIG. 4. Starting at the back deck 18 of the toilet 20, a gasket 34 is sandwiched between the back deck 18 and a lower housing 36 of the base assembly 12. The gasket 34 is sized to accommodate minor irregularities between the back deck 18 and the lower housing 36, and to reduce vibration transfer from the base assembly 12 during operation. The gasket 34 may be made of rubber, foam, and the like. The gasket 34 may be secured in place with a pressure sensitive adhesive or any other suitable means.

The lower housing 36 has three electrical conduits extending from its bottom surface, including a main power lead 38 for supplying power to the attachment assembly 10. The main power lead 38 is preferably in communication with a power source (not shown), such as a one hundred and ten volt, sixty Hertz line that is common in the United States. The two remaining conduits are a pump communication lead 40 and a courtesy flush lead 42. The pump communication lead 40 is operationally coupled to an electric pump (not shown) for expelling the contents of the toilet bowl 26. The courtesy flush lead 42 is coupled to a courtesy flush switch 43 allowing the user to flush the toilet 20 when desired and independent of any automated preferences. As noted above, the invention may be configured to operate with a pump-less, tank-type toilet; in that scenario, the communication lead 40 and courtesy flush lead 42 may be coupled to a valve actuator (not shown) for flushing the toilet 20.

A logic controller 44, shown simplified in FIG. 4, provides the operational logic of the attachment assembly 10. In the example embodiment, the logic controller 44 is a printed circuit board running a program to monitor and control the attachment assembly 10 and toilet 20. The logic controller 44 is operationally coupled to the main power lead 38, the pump communication lead 40, and the courtesy flush lead 42. Additionally, the logic controller 44 is operationally connected to the option selection switches 32 for receiving input regarding the operation of the attachment assembly 10. For example, actuating or toggling the bowl light option selection switch 32B causes the logic controller 44 to supply power to a light emitting diode (not shown) housed within the toilet bowl 26, thus providing illumination where needed. Other functions of the logic controller 44 will become evident throughout the balance of the description of the example embodiment. The logic controller 44 is preferably secured to the lower housing 36 with fasteners, as is commonly done; however the logic controller 44 may be located or integrated in various configurations, such as proximate to or integral with a general toilet controller (not show).

An upper housing 46 defines a cavity 49 and a pair of hinge mounts 50 aligned along the hinge axis 22. The cavity 49 houses a seat motor 47 and a lid motor 48 configured to pivotally drive the seat 14 and lid 16 respectively. The seat motor 47 is operationally coupled to the logic controller 44 by the seat motor connector 52 and the lid motor 48 is operationally coupled to the logic controller 44 by the lid motor connector 54. In the example embodiment, the seat motor 47 and lid motor 48 are axially aligned along a motor axis 56 that is offset parallel to the hinge axis 22.

The lower housing 36 and the upper housing 46 may be aligned with alignment pins 37 and secured by fasteners (not shown), such as screws. The lower housing 36 and the upper housing 46 of the base assembly 12 are made of molded plastic in the example embodiment, but may be constructed of metal, composites, and the like, and cast, machined, or produced from various manufacturing techniques.

The seat motor 47 and lid motor 48 are operationally coupled to pivot the seat 14 and lid 16 respectively. The seat motor 47 engages the input of seat gears 58. The seat gears 58 include a torsion spring (not shown) biasing the seat gears 58 to the open or raised seat 14 position. This reduces the torque required by the seat motor 47 while raising the seat 14. Similarly, the lid motor 48 engages the input of lid gears 60 and operates to open and close the lid 16. The seat gears 58 and lid gears 60 include planetary gears and are available from Johnson Electric North America, Inc., of Shelton, Conn.

Figure 5:
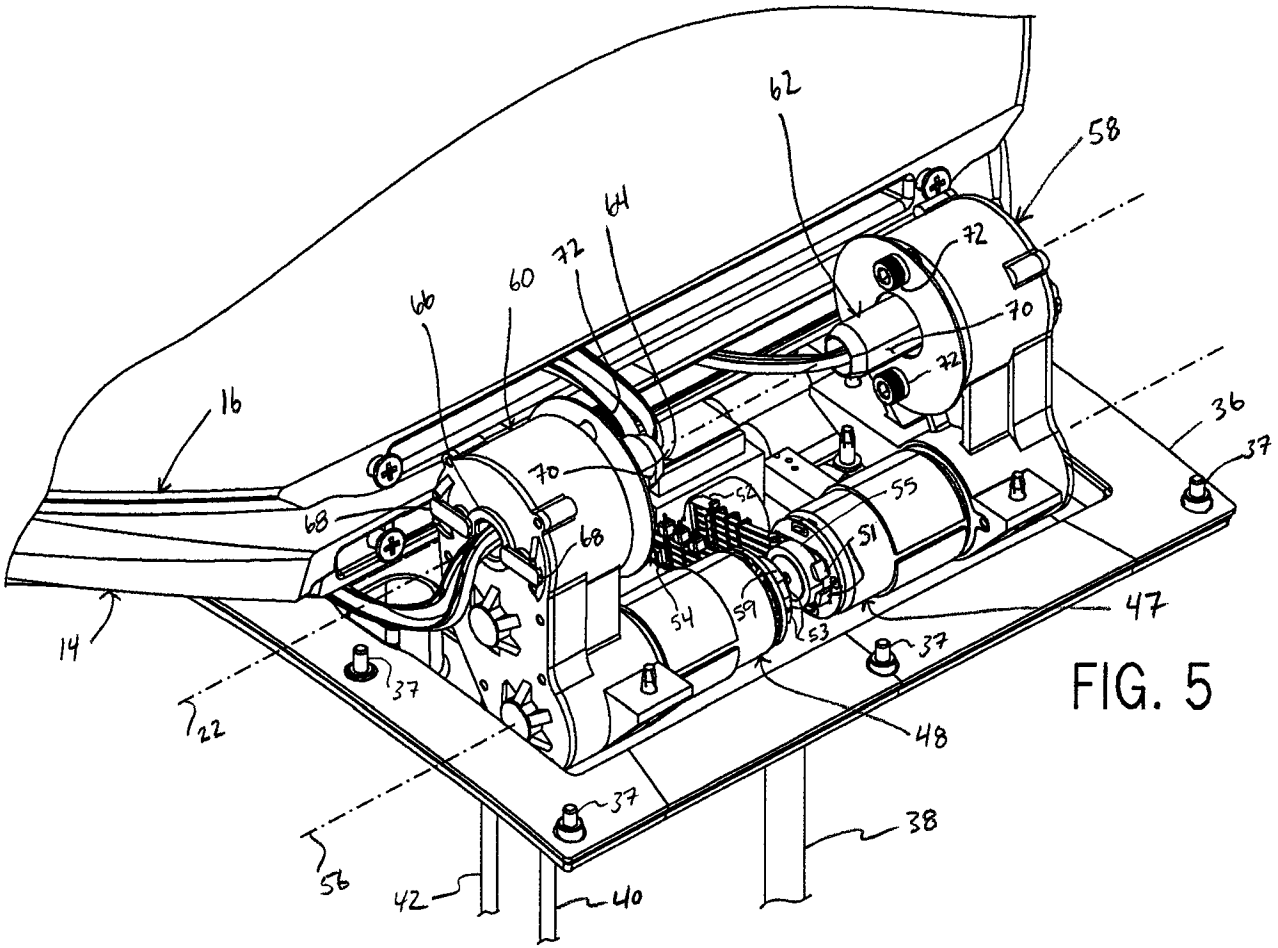
FIG. 5 is partial, rear perspective view showing the automation mechanism of the attachment assembly.
Figure 6:
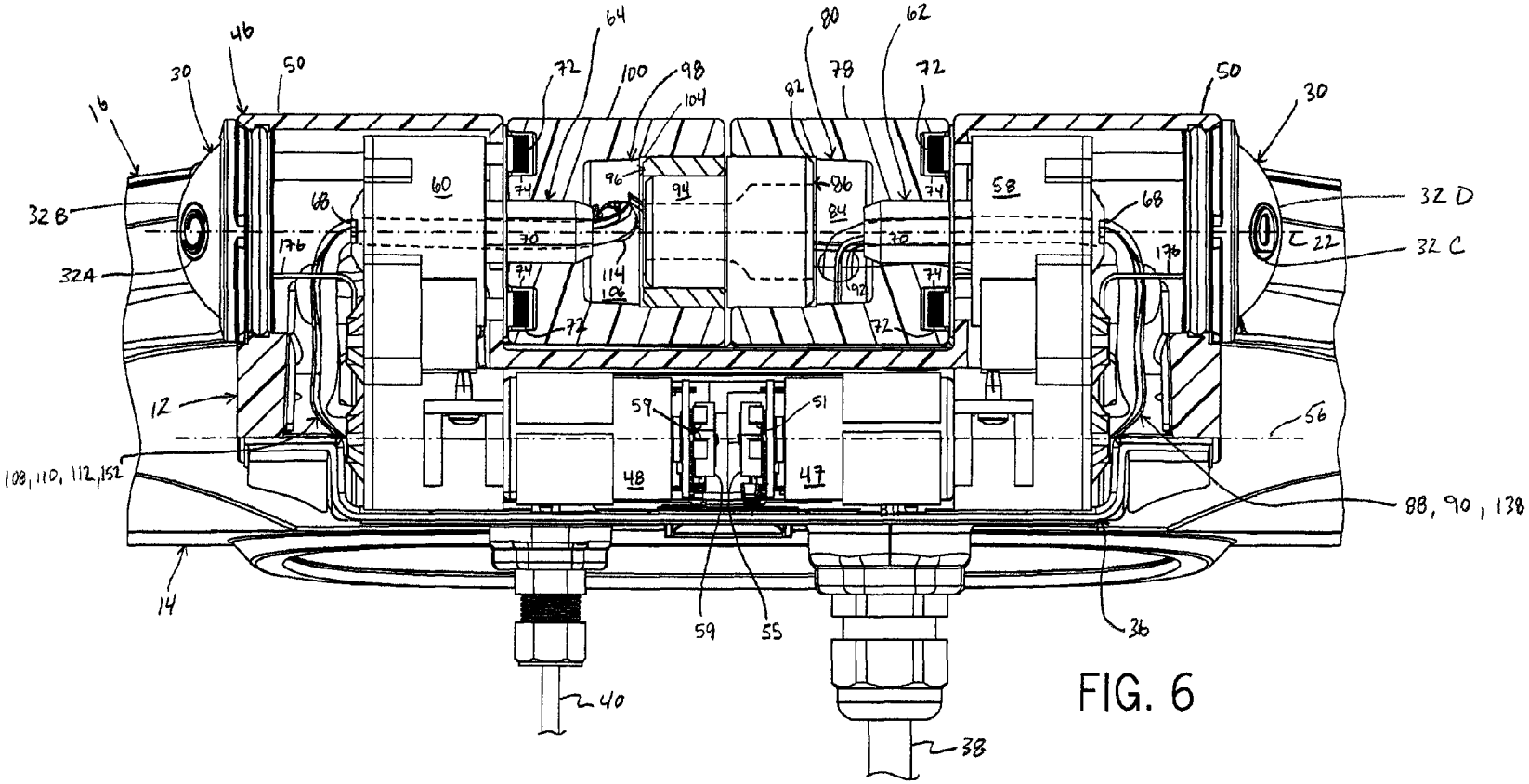
FIG. 6 is a partial, rear section view along line 6-6 of FIG. 1.

With specific reference to FIGS. 4, 5, and 6, the output of the seat gears 58 and lid gears 60 are coupled to a seat drive shaft 62 and a lid drive shaft 64, respectively. The seat drive shaft 62 and the lid drive shaft 64 are hollow, cylindrical shafts having a flange 66 at one end for preventing the drive shaft 62, 64 from sliding completely through hinge mounts 50 when inserted from the outside of the base assembly 12. The seat drive shaft 62 and the lid drive shaft 64 are axially restrained in the hinge mounts 50 by a pair of stop tabs 68 that are pivoted over the flange 66 and snap-fit into a recess. The seat drive shaft 62 and the lid drive shaft 64 further include a pair of parallel, spaced-apart flat sides 70 that engage mating bearing surfaces on the seat 14 and the lid 16 to transfer the rotational energy produced by the respective seat motor 47 and lid motor 48 to ultimately raise and lower the seat 14 and the lid 16. In the example embodiment, operation of the seat motor 47 and the lid motor 48 is controlled by predetermined logic programmed into the logic controller 44 and will be described in more detail below.

To pivot or move the bowl attachments, the example embodiment employs an actuator in the form of an electric motor and a gear train; however, various alterations are within the scope of the present invention. For example, a single actuator in conjunction with a clutch system could be used to pivot the seat 14 and the lid 16. Alternatively, a hydraulic actuator in combination with a power screw could be configured to raise and lower the seat 14 and lid 16. Where an electric actuator is used, such as an electric motor, the type (e.g., A.C. or D.C.), torque rating, maximum rotational velocity, and the like are application specific and may be tailored to the size, weight, and desired operating speed of the bowl attachments. Many other variations exist and are within the scope of the present invention.

Until the rotational extremes of the bowl attachments (e.g., fully opened and fully closed) are stored in the logic controller 44 as a result of the initiation sequence (described below), the combination of stops 72, grooves 74, and current monitoring of the motors 47, 48 limits the rotational extremes of the seat 14 and lid 16 about the hinge axis 22. Each hinge mount 50 includes a pair of rotational stops 72 extending inward from the hinge mount 50 and are preferably spaced one hundred and eighty degrees apart. Each pair of rotational stops 72 rides in mating, arcuate grooves 74 formed in the seat 14 and lid 16. When the bowl attachments reach a rotational extreme, the stops 72 bear against the extremes of the mating grooves 74 causing the motors 47, 48 to draw an excess amount of current. The logic controller 44 is programmed to monitor the current draw of the motors 47, 48 and de-energize the motors 47, 48 when the motors 47, 48 exceed a predetermined maximum current. Preferably, however, the logic controller 44 is programmed to determine the rotational extremes of the bowl attachments during the initiation sequence, thus minimizing the wear on the motors 47, 48 during the high current draws. The current monitoring capability of the logic controller 44 is also incorporated in the manual-urging automation and pinch protection scenarios described in detail below.

The pivotal movement of the seat 14 and lid 16, either raising or lowering, is monitored by seat movement sensors 51 and lid movement sensors 53, respectively. As shown most clearly in FIG. 6, the seat movement sensors 51 are mounted ninety degrees out of phase and adjacent the seat motor 47. A multi-pole seat movement magnet 55 is secured to the seat motor 47 so as to rotate in conjunction with the seat motor 47. As the seat 14 is rotated by a manual urging, for example, the seat gears 58 rotate causing the seat motor 47 and attached seat movement magnet 55 to rotate. The rotation direction, i.e., raising or lowering, is determined by the signals received by the seat movement sensors 51, a technique that is well know to those having ordinary skill in the art. The seat movement sensors 51 are operationally coupled to the logic controller 44, which may be programmed to take a particular action as a result of movement of the seat 14 (e.g., energize the seat motor 47 in the sensed direction of rotation to eliminate the need for the user to continue urging the seat 14). The lid motor 48 includes an identical pair of lid movement sensors 57 and a lid movement magnet 59 coupled to the lid motor 48. The basic operation and implementation of the lid movement sensors 57 is identical to that of the seat movement sensors 51.

While the example embodiment utilizes Hall Effect sensors to monitor the rotation or pivoting of the seat 14 and lid 16, many other monitoring techniques are available. For example, optical based sensors may easily be incorporated and configured to sense the rotational direction of the seat 14 and lid 16.

With general reference to FIGS. 4 and 6, the seat 14 and the lid 16 are shown rotatably coupled about the hinge axis 22. The seat 14 includes a seat mount 76 with a seat hinge 78 extending rearwardly therefrom. The seat hinge 78 includes a cavity 80 having a bearing portion 82 and a clearance portion 84. A stepped, inner bearing 86 is housed within the bearing portion 82 of the cavity 80. Seat heater leads 88, seat object sensor leads 90 (when present), and seat thermistor leads 138 are routed from the logic controller 44, through the seat drive shaft 62, through the lead opening 92 formed in the clearance portion 84 of the cavity 80 between seat mounting tabs 140, and into the seat 14. The various component leads of the attachment assembly 10 are shown throughout the figures in a simplified manner to improve clarity. Furthermore, one of ordinary skill will appreciate the various ways available in which to operationally connect the components.

The stepped down portion 94 of the inner bearing 86 extends partially into an outer bearing 96 that is housed in a cavity 98 formed in a lid hinge 100 extending rearwardly from a lid mount 102. The cavity 98 includes a bearing portion 104 and a clearance portion 106. Lid heater leads 108, lid object sensor leads 110, switch leads 112, and lid thermistor lead 152 are routed from the logic controller 44, through the lid drive shaft 64, through the lead opening 114 formed in the clearance portion 106 of the cavity 98 between the mounting tabs 154, and into the lid 16. The configuration of the seat hinge 78, lid hinge 100, inner bearing 86, and outer bearing 96 allows the seat 14 and lid 16 to rotate relative to the other about the hinge axis 22 without binding on the seat heater leads 88, seat object sensor leads 90, seat thermistor lead 138, lid heater leads 108, lid object sensor leads 110, lid thermistor lead 152, or switch leads 112.

Figure 7:
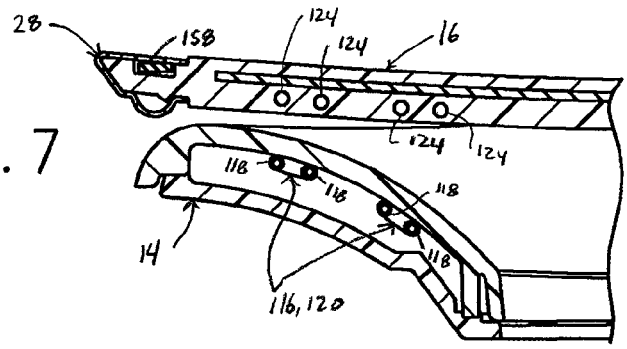
FIG. 7 is a partial, section view along line 7-7 of FIG. 1.

A partial cross-section of the bowl attachments is shown in FIG. 7. The seat heater 116 and associated seat heating elements 118 are shown housed within the seat 14. Additionally, in the example embodiment, a seat object sensor 120, for detecting the presence or absence of an object adjacent the seat 14, is electrically coupled to the seat heating elements 118 and therefore does not require any additional components in the seat 14. The lid 16 has similar components, albeit configured alternatively. The lid heater 122 and associated lid heating elements 124, and the lid object sensor 128 are integrally molded into the lid 16. Alternatively, the lid heater 122 and/or lid object sensor 128 may be routed in annular channels (not shown) formed in the underside of the lid 16. The lid object sensor 128 may also be electrically isolated, capacitive coupled, or multiplexed with the lid heater 122 and associated circuitry. Lastly, the switch leads 112 are housed in a channel 130 extending along the periphery of the lid 16 (shown in FIG. 10).

Figure 8:
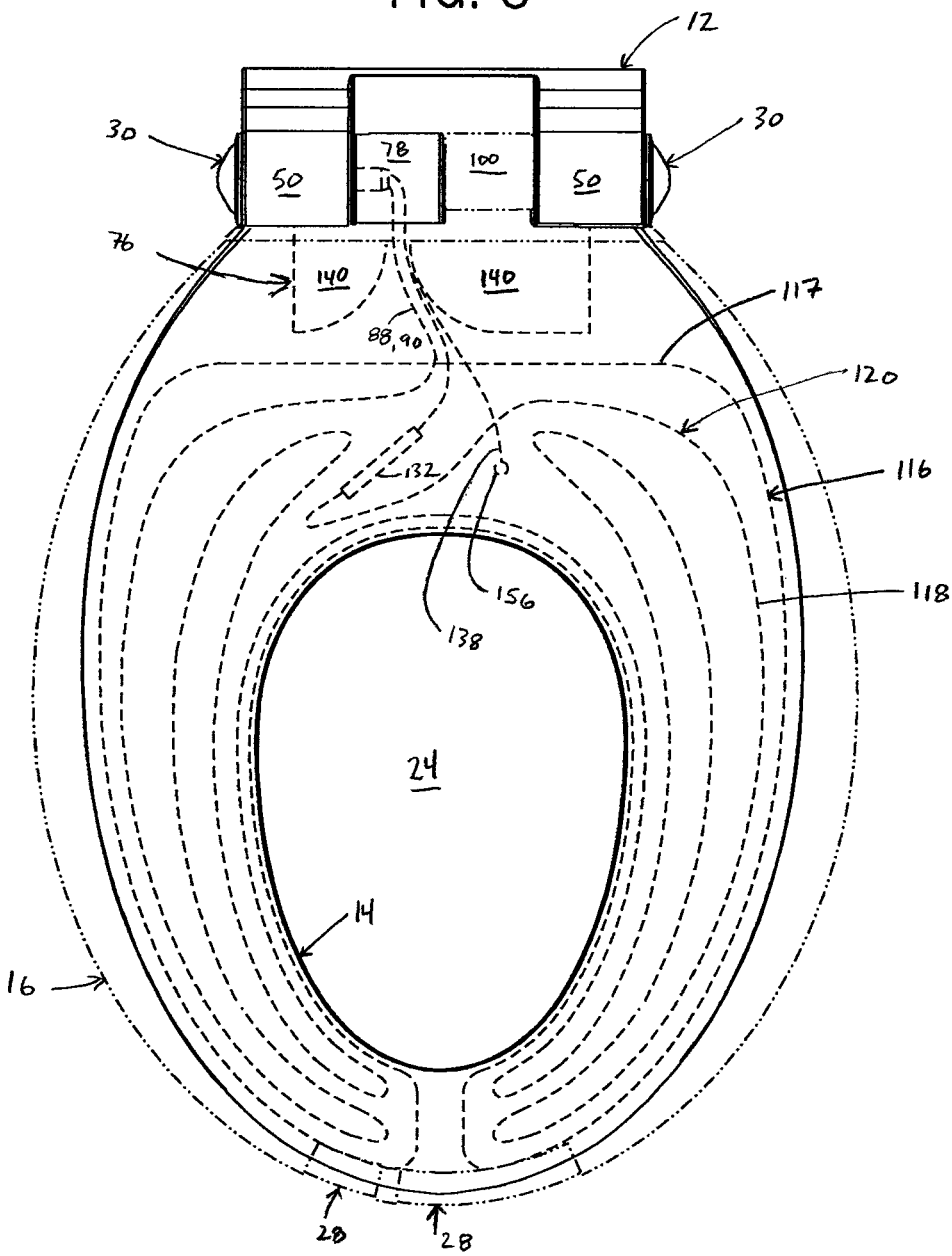
FIG. 8 is a top view of the attachment assembly showing the lid in hidden lines.
Figure 9:
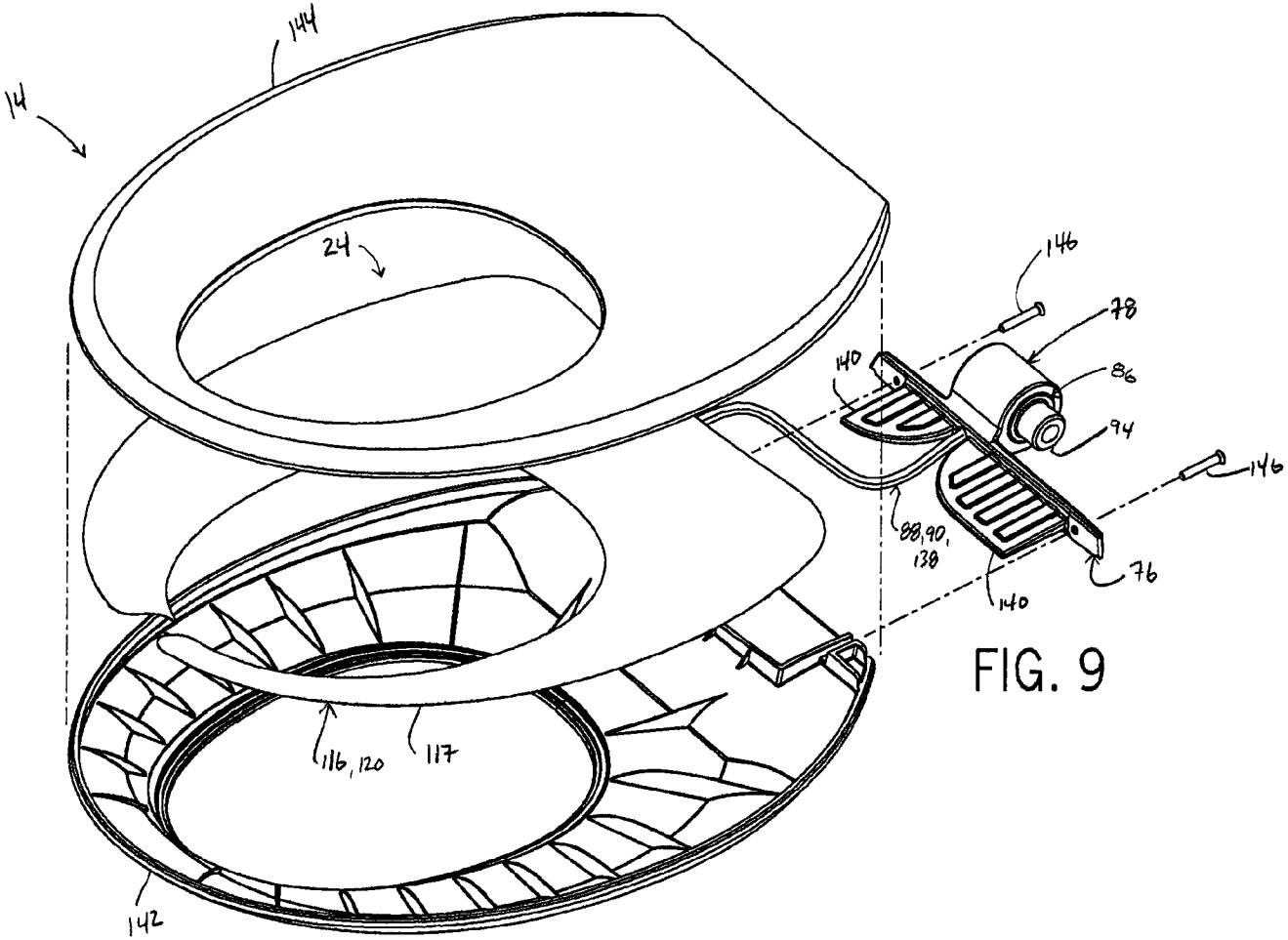
FIG. 9 is an exploded, top perspective view of the seat.

The elements and construction of the seat 14 are illustrated in FIGS. 8 and 9. Turning first to FIG. 8, the seat heater 116 and example routing of the seat heating elements 118 is shown by dashed lines. The seat heating elements 118 are preferably restrained and spaced apart in a seat heater mat 117 (shown in FIG. 9) to ensure an essentially uniform distribution of heat to the seat 14. The seat heating elements 118 have multiple heat settings allowing the user to select, for example, a seat 14 temperature of ninety-five degrees Fahrenheit, one hundred degrees Fahrenheit, and one hundred and four degrees Fahrenheit. The logic controller 44 includes a transformer to step down the one hundred and ten volt main power to twenty-four volts as required by the seat heater 116 of the example embodiment.

The seat heater 116 includes a thermal fuse 132 to prevent damage to the logic controller 44 should the seat heating elements 118 become damaged and the temperature of the seat 14 exceed approximately one hundred and sixty degrees Fahrenheit. Additionally, a thermistor 136 is housed within the seat 14 to monitor the temperature of the seat 14 and communicate the temperature to the logic controller 44 that in turn adjusts the power sent to the seat heating elements 118.

The seat object sensor 120 is capable of sensing the presence, or absence, of an object that is located adjacent or near the seat 14 and is preferably a tuned capacitive sensor circuit that is operationally coupled to the logic controller 44. As an object encounters the seat 14, for example, the hand of a user, the capacitance of the seat object sensor 120 is altered. This change in capacitance is monitored by the logic controller 44 and used as an input to the programmed logic of the logic controller 44. For example, assuming the seat 14 is in the lowered position and the lid 16 is in the raised position, if the seat object sensor 120 senses an object adjacent the seat 14, the logic controller 44 may disable the switch assemblies 28 to prevent the object from being pinched by the lid 16 or from the seat 14 attempting to pivot to the raised position with an object thereon and potentially damaging the seat motor 47. In the example embodiment, the seat object sensor 120 is operationally coupled with the seat heating elements 118, meaning that the logic controller 44 is programmed to monitor the capacitance of the heating elements 118 and alter the operational logic accordingly (e.g., prevent the seat 14 from attempting to raise when an object is sensed on the seat 14).

It is of note that the seat object sensor 120, while depicted in the example embodiment as a being integrated with the seat heater 116, may be configured to be a variety of conductive elements separate from the seat heater 116. For example, the seat object sensor (and object sensors of the present invention in general) may comprise a conductive element (e.g., a foil element) sandwiched between the lower seat portion 142 and upper seat portion 144, similar to the placement of the seat heater 116. Alternatively, the object sensor 120 could comprise a sprayed-on electrically conductive coating or paint that is coupled to the logic controller 44 where changes in capacitance are monitored. In yet another variation, the seat 14 itself could be made of an electrically conductive material, which is then coupled to the logic controller 44 and monitored for changes in capacitance. These non-exhaustive variations are within the scope of the present invention.

Additionally, in certain circumstances, the object sensor 120 need not be coupled to, or only to, the logic controller 44 of the attachment assembly 10, but may instead be used to provide a signal indicating when the toilet 20 is in use to a separate logic controller. For example, in an assisted care facility a signal may be sent from an object sensor to a logic controller that then displays the status of the monitored toilets 20 to facility staff.

The various seat 14 component leads, i.e., the seat heater leads 88, seat thermistor leads 138, and the seat object sensor leads 90, when present, are routed through the opening 92 in the seat hinge 78 between seat mounting tabs 140 and proceed to the logic controller 44 where they are coupled to the logic controller 44 in a manner known by those having ordinary skill in the art.

An exploded view of a seat 14 in accordance with the example embodiment is shown in FIG. 9. The seat 14 is comprised of a lower seat portion 142 and an upper seat portion 144. The seat heater 116, integrated seat object sensor 120, and thermistor 136 are sandwiched between the lower seat portion 142 and upper seat portion 144. The seat mounting tabs 140 are inserted into the seat 14 and the seat mount 76 is secured to the seat 14 by a pair of fasteners 146. The lower seat portion 142 and upper seat portion 144 may be releasably coupled, e.g., by a series of latches and hooks, or more permanently coupled, e.g., by ultrasonic welding the portions 142, 144 together when the lower seat portion 142 and upper seat portion 144 are made of plastic. The lower seat portion 142 and upper seat portion 144 may be produced from a variety of materials, from plastic, metal, composites, and the like.

Figure 10:
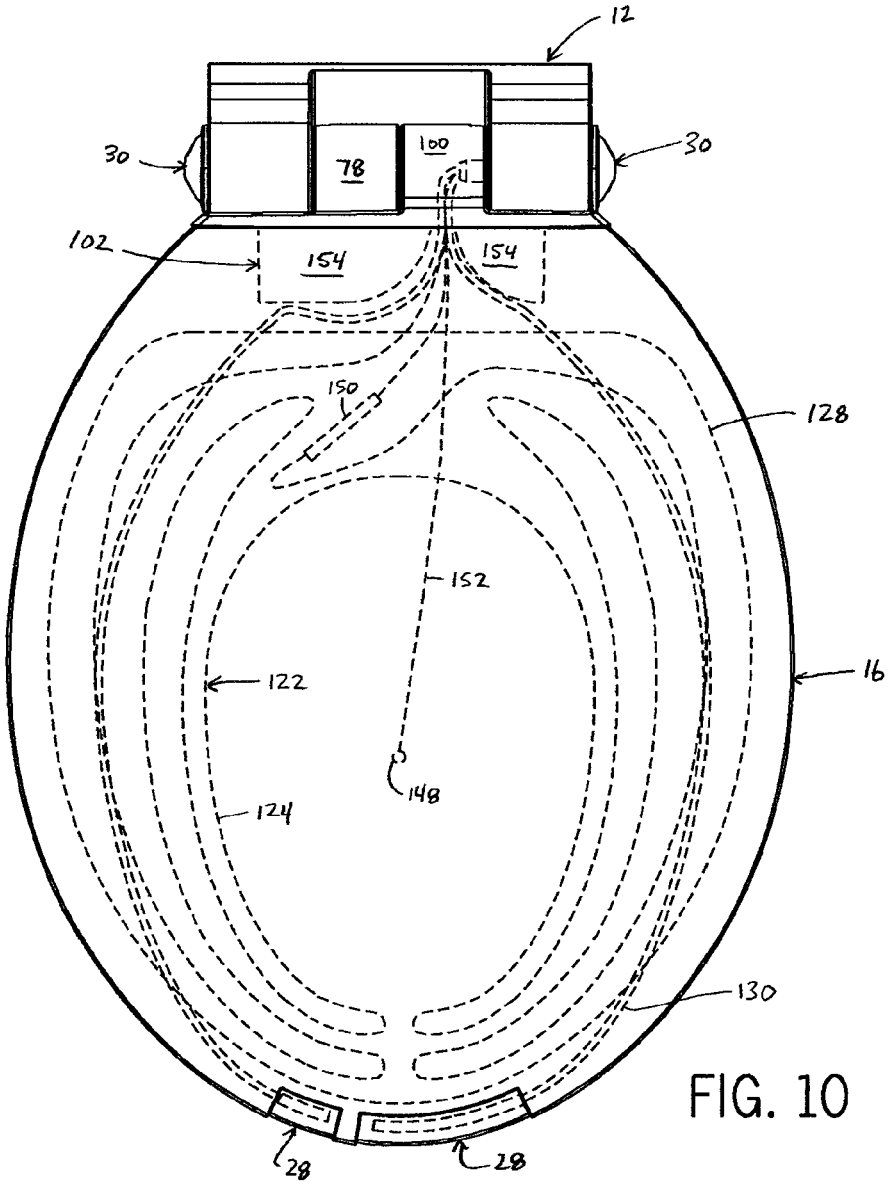
FIG. 10 is a top view of the attachment assembly.
Figure 11:
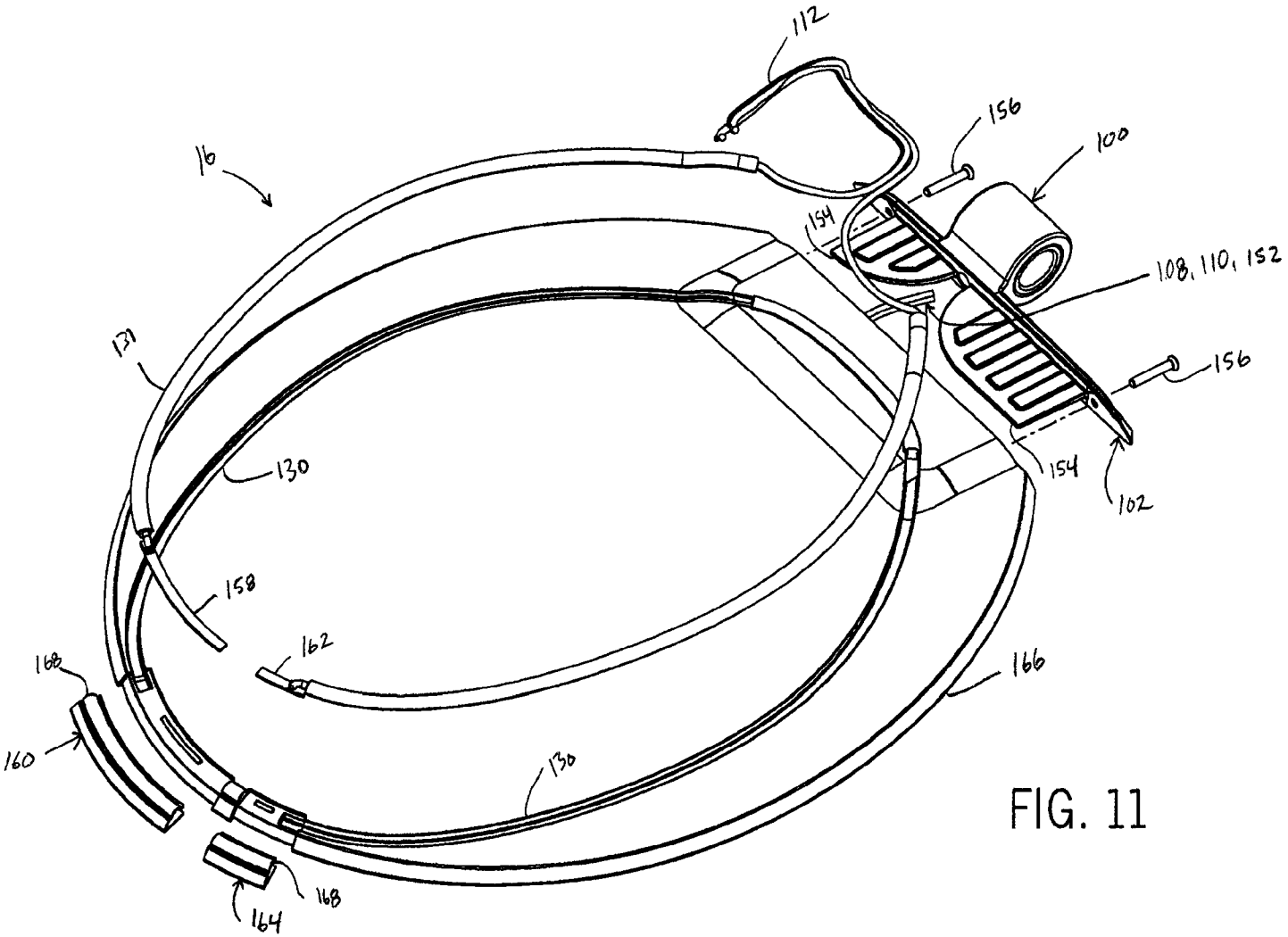
FIG. 11 is an exploded, bottom perspective view of the lid.

Turning now to the lid 16, the elements and construction of the lid 16 are illustrated in FIGS. 10 and 11. Referencing first FIG. 10, the lid heater 122 and example routing of the lid heating elements 124 throughout the lid 16 is shown. In the example embodiment, the lid heating elements 124 are integrally molded within the lid 16. Alternatively, as with the assembly of the seat heating elements 118, the lid 16 may be made of two portions with the lid heating elements 124 sandwiched there between. Also, similar to the seat 14 configuration, a lid thermistor 148 and a thermal fuse 150 are incorporated into the lid 16 to monitor and control the temperature of the lid 16.

The switch assemblies 28 are housed in the channel 130 that is preferably formed around the periphery of the lid 16. In the example embodiment, the switch leads 112 are routed through an extruded plastic bumper 131, which is then pressed into the channel 130. The bumper 131 also acts as a cushion or annular standoff between the seat 14 and the lid 16. The lid heater leads 108, lid thermistor lead 152, lid object sensor leads 110, and switch leads 112 are routed through the opening 114 in the lid hinge 100 between lid mounting tabs 154, and proceed to the logic controller 44.

In contrast to the seat object sensor 120 that is integrated with the seat heater 116, the lid object sensor 128 comprises a conductive foil element that is integrally molded within the lid 16 and operationally coupled to the logic controller 44. The expansive conductive foil element allows the logic controller 44 to monitor the majority, if not all, of the lid 16 for nearby objects. Again, the lid object sensor 128 need not be integrally molded within the lid 16, but instead may be any of the variations discussed in reference to the seat object sensor (i.e., sandwiched between two portions of the lid 16, the lid 16 itself made of a conductive material, a conductive coating applied to the lid 16 and coupled to the logic controller 44, and the like).

Generally, the seat object sensor 120 and lid object sensor 128 are configured to prevent rotation of the bowl attachments, via either switch automation or manual-urging automation, when an object is adjacent the bowl attachments. This includes the scenario wherein a user is sitting atop the lid 16 when the seat 14 and lid 16 are in the closed positions. The lid object sensor 128 would sense the presence of a person sitting atop the lid 16 and disable the switches 158, 162 and thus motors 47, 48. As a second example, if a person is seated on the seat 14, accidental actuation of a switch 158, 162 will not cause the seat 14 to raise or cause the lid 16 to lower, because the object sensors 120, 128 would sense the user and prevent the inadvertent actuation of the motors 47, 48.

An exploded view of the lid 16, as seen from the bottom, is shown in FIG. 11. The lid mount 102 includes lid mounting tabs 154 that extend into a lid body 166. The lid mount 102 is preferably secured to the lid body 166 by fasteners 156. The switch assemblies 28 are comprised of several components. In the example embodiment, a first switch 158 is housed under a first switch cover 160 and a smaller second switch 162 is housed under a second switch cover 164. The first switch cover 160 and the second switch cover 164 have C-shaped cross-sections so as to flex over the lid body 166 and snap securely to the lid body 166. The switch covers 160, 164 include a channel portion 168 providing clearance for the switches 158, 162 and the lid object sensor 128. In the example embodiment, the switch assemblies 28 are preferably capacitive touch switches, however, the switch assemblies 28 may be any of numerous switches or sensors, such as induction switches, infrared motion sensitive switches, and the like.

All of the seat 14 variations discussed above, including those corresponding to the lid heater 122 and lid object sensor 128, are equally applicable to the lid 16.

Figure 12:
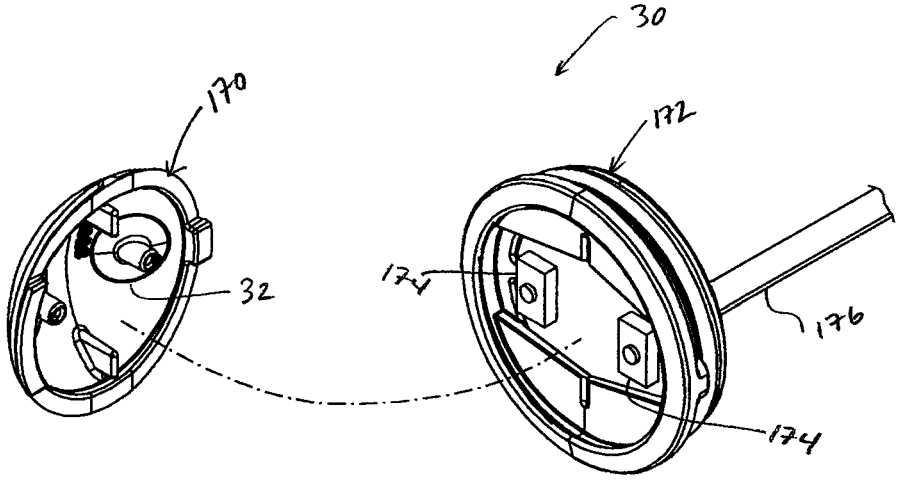
FIG. 12 is a partial, section view of an option selection switch.

Turning to FIG. 12 the main components of the option selection switch assembly 30 are illustrated. The option selection switch assemblies 30 house the selection switches 32 that communicate with the logic controller 44 to modify the operating conditions of the attachment assembly 10. A switch cover 170 houses the selection switches 32. A switch base 172 includes a pair of contacts 174 that are operationally connected to the logic controller 44 by option selection switch lead 176. The switches 32 may be configured such that toggling the switches 32 can alter functions such as the seat heater 116, bowl light, and the like. The option selection switch assemblies 30 are secured to the base assembly 12 along the hinge axis 22, providing convenient, sanitary access to the controls while minimizing inadvertent switching.

With the structure and basic operation of the components described, we turn our attention to the operation of the attachment assembly 10, including manual-urging automation and switch automation.

Manual-urging automation, or power assist, occurs when a user manually urges the bowl attachment, e.g., the seat 14 or the lid 16, from a first position or configuration to a second position or configuration; the movement of the bowl attachment activates an actuator to assist the desired movement. Switch automation occurs when a user toggles or switches one or more of the switches 158, 162 that in turn activates an actuator or motor 47, 48 to pivot or rotate the bowl attachment, e.g., the seat 14 or the lid 16, from a closed or lowered position to a raised or upper position; the rotational extremes of the example embodiment are generally illustrated in FIGS. 1-3.

Figure 2:
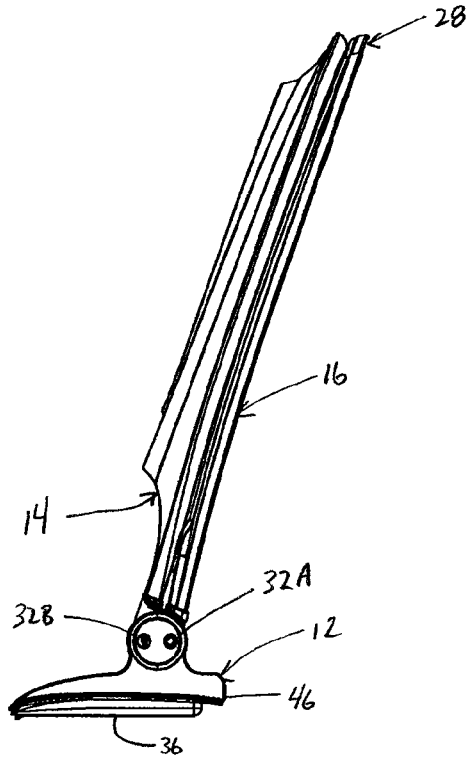
FIG. 2 is a right side view of the attachment assembly with the bowl attachments raised.
Figure 3:
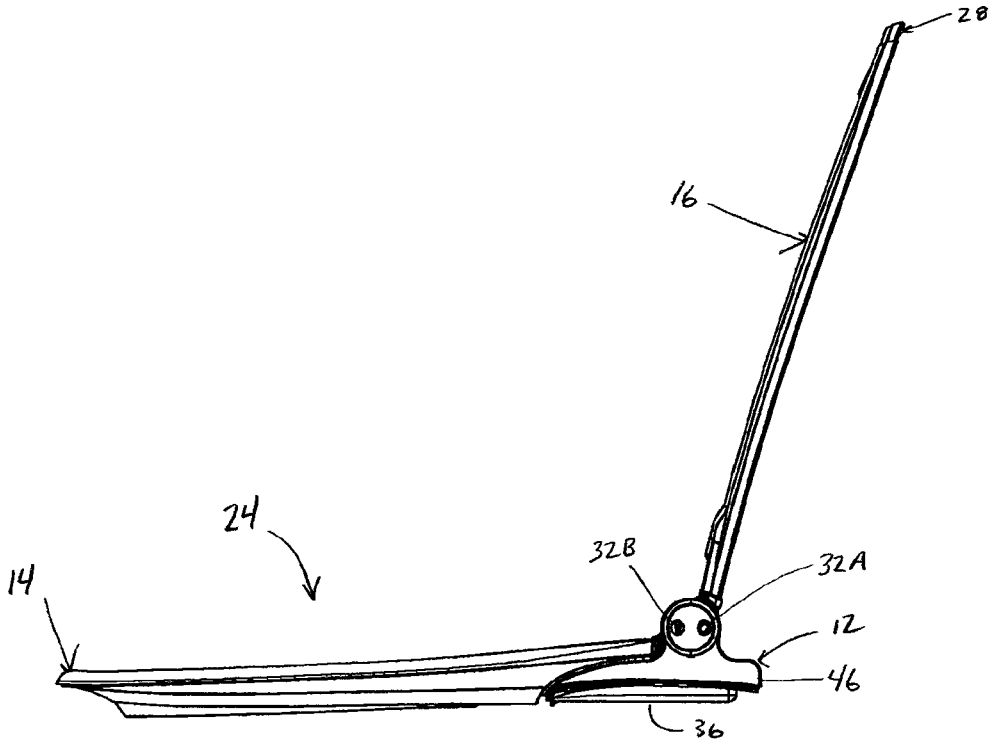
FIG. 3 is a right side view of the attachment assembly with the lid raised and the seat lowered.

It is of note that neither manual-urging automation or switch automation requires that the bowl attachment be at a rotational extreme (shown in FIGS. 1-3). Nor is it required that the bowl attachment be stationary when the automation is activated, either by urging or by toggling a switch. The movement of the bowl attachments may be altered while each is in motion.

In the example embodiment, the manual-urging automation is combined with the switch automation; however, either may be used alone depending upon the application requirements.

We turn our attention to switch automation of the bowl attachments. First, it is of note that the current monitoring features described above are equally applicable in the switch automation scenario. In either situation, when a bowl attachment encounters resistance causing an increase in the current draw of the motor(s) 47, 48, the logic controller 44 responds accordingly by de-energizing the motor(s) 47, 48 and perhaps reversing the pivotal rotation of the bowl attachment to pivot away from the apparent resistance.

In order for manual-urging automation or switch automation to operate properly, it is important that the logic controller 44 "knows" the position of the seat 14 and lid 16 at all times, and especially upon initialization. While it is possible to equip the seat 14 and lid 16 with absolute rotational positions sensors that in turn communicate positioning to the logic controller 44, a more economical approach uses an initial indexing sequence to define and set the rotational extremes of the bowl attachments. If the logic controller 44 has not stored the position (e.g., raised or lowered) and the rotation required to pivot a bowl attachment from closed to open, an indexing sequence is used to identify the position and range of movement of the bowl attachment. Alternatively, the logic controller 44 could be programmed for each particular bowl attachment scenario, however, the initial indexing sequence has the benefit of allowing a logic controller to control various bowl attachment configurations and account for changes over time.

In the example embodiment, a four-try indexing sequence is used during which the motors 47, 48 operate at half-speed. The logic controller 44 will attempt to first open the lid 16; if this is successful, meaning that the lid motor 48 was energized without drawing an excessive amount of current soon after being energized, the logic controller 44 may store the position of the lid 16 as open. Second, the logic controller 44 will attempt to close the seat 14; if this is successful the logic controller 44 may store the position of the seat 14 as closed. Third, the logic controller 44 will attempt to open the seat 14; if this is successful the logic controller 44 may store the position of the seat 14 as open as well as the position of the lid 16 as open, because the seat 14 cannot be open unless the lid 16 is open. Finally, the logic controller 44 will attempt to close the lid 16; if this is successful the logic controller 44 may store the position of the lid 16 as closed and the position of the seat 14 as closed, given the seat 14 cannot be open when the lid 16 is closed. As previously discussed, the stops 72 and grooves 74 define the rotational extremes and result in the current monitoring feature of the logic controller 44 de-energizing the motors 47, 48 shortly after the grooves 74 contact the stops 72.

Throughout these operations, the logic controller 44 is monitoring and counting the pulses from the movement sensors 51, 57. The number of pulses received determines the range of bowl attachment rotation and thus defines the rotational extremes. This information is stored and allows the logic controller 44 to stop the motors 47, 48 prior to the current exceeding an appreciable level, thus minimizing the wear on the motors 47, 48 and associated components. With the position of the seat 14 and lid 16 stored, the logic controller 44 may proceed to more aptly manipulate the bowl attachments in response to manual urging, current monitoring, and switch actuation.

In general, the manual-urging automation, or power assist, operates by identifying manual movement of a bowl attachment, here the seat 14 and/or the lid 16, from a first position to a second position. When manual movement is identified, the movement of the bowl attachment is then assisted by, for example, energizing the appropriate actuator, here motors 47, 48, in the identified rotational direction. Again, the first and second positions need not be the rotational extremes of the bowl attachments, but may instead be any intermediate position.

In the example embodiment, the seat movement sensors 51 and the lid movement sensors 57 monitor the rotation of the seat motor 47 and lid motor 48, respectively, via seat movement magnet 55 and lid movement magnet 59. As the seat 14 and/or lid 16 are rotated, the movement sensors 51, 57 monitor and identify the movement and indicate to the logic controller 44 the bowl attachment motion and the direction of travel. The logic controller 44 then energizes the bowl attachment in accordance with the direction of manual-urging so that the user no longer must urge the bowl attachment.

For example, assuming the seat 14 and lid 16 begin in the closed or lower positions, as a user begins to lift the lid 16, the lid hinge 100 begins to rotate. The lid hinge 100 in turn causes the mating lid drive shaft 64 to rotate accordingly. The lid drive shaft 64 is coupled to the lid gears 60 that in turn cause the lid motor 48 to rotate. Next, the lid movement sensors 57 monitoring the lid movement magnet 59 identify the rotation of the lid movement magnet 59 indicating that the user is manually urging the lid 16 open. This is communicated to the logic controller 44 that energizes the lid motor 48 to begin raising the lid 16 as desired by the user. The lid motor 48 remains energized until the logic controller 44 de-energizes the lid motor 48 either due to reaching the rotational extreme identified during the initial indexing sequence or due to current monitoring/pinch protection.

The logic controller 44 continues to monitor the bowl attachments, even during movement. If a user urges the bowl attachment in the opposite direction of rotation or attempts to stop the rotation, the current monitor and logic controller 44 adjust the movement by de-energizing the energized motor(s) 47, 48. Furthermore, if switches 158, 162 are present, the switch(s) 158, 162 are monitored for actuation. If the switches 158, 162 are switched, the movement of the bowl attachments is adjusted accordingly. The logic controller 44 preferably prevents the user from causing the bowl attachments to collide by, for example, urging the seat 14 opened and urging the lid 16 closed.

At least two scenarios may cause the current sensor to exceed the programmed threshold level. Namely, a bowl attachment reaching a rotational extreme or a bowl attachment encountering an impediment during rotation. First, for example, when the lid 16 reaches the raised rotational extreme, the grooves 74 in the lid hinge 100 bear against stops 72, causing the lid motor 48 to draw excess current. This is what occurs during the initial indexing sequence. Second, if while the lid 16 is rotating towards the open rotational extreme, the user applies a manual urging against the present rotation of the lid 16, the current drawn by the lid motor 48 will increase and the logic controller 44 will de-energize the lid motor 48. Continued manual urging by the user to rotate the lid 16 in the lowered or closed direction will cause the lid movement sensors 57 to signal to the logic controller 44 the desired rotational travel of the lid 16. The logic controller 44 will again energize the lid motor 48, however, the lid motor 48 will be energized in the reverse rotational direction as before to effectuate closing of the lid 16. If, during closing of the lid 16, the current of the lid motor 48 exceeds the predetermined threshold, the logic controller 44 will again de-energize the lid motor 48 to prevent damage to the lid motor 48 and provide pinch protection should a user accidentally be in the rotational path of the closing lid 16. The seat 14 responds similarly during manual-urging automation. The logic controller 44 may be programmed to reverse direction of the bowl attachments in some circumstances; for example, when the lid 16 encounters an obstruction during closing, the rotation of the lid motor 48 may be reversed to pivot the lid 16 open and away from the perceived object.

Manual-urging automation of the seat 14 operates in substantially the same manner as that described in relation to the lid 16. Two additional items are of note. First, when multiple bowl attachments, e.g., the seat 14 and the lid 16, are present and automated, the logic controller 44 is preferably configured to prevent illogical movement of the bowl attachments. For example, the logic controller 44 may be programmed to prevent a user from raising the seat 14 and at the same time lowering the lid 16. Obviously this scenario would cause the seat 14 and lid 16 to interfere with one another. Second, where a switch, here first switch 158 and second switch 162, is incorporated into the bowl attachment control, switching or toggling of the switch may supersede the previous manual urging of the user, causing the bowl attachment to respond according to the preprogrammed bowl attachment logic of the logic controller 44.

The switch automation logic programmed into the logic controller 44 is best understood with reference to Tables A and B below. Each table indicates the output of the logic controller 44, that is the energize, de-energize signals sent to the actuators (here the seat motor 47 and the lid motor 48) depending upon the rotational status of the bowl attachments to open or close the bowl attachments. Four operating states of the seat 14 are listed across the first row of the table, namely, seat 14 opened, seat 14 closed, seat 14 opening, and seat 14 closing. Similarly, four operating states of the lid 16 are listed along the first column, namely, lid 16 opened, lid 16 closed, lid 16 opening, and lid 16 closing. Each time the logic controller 44 receives an input from a switch 158, 162 that it has been toggled, the logic controller 44 identifies the operating state of the bowl attachments and obtains the new operating parameters from the programmed logic as depicted in Table A (for the first switch 158) and in Table B (for the second switch 162).

In the example embodiment, the seat 14 may not be opened without the lid 16 being in the opened state, or being opened simultaneously with the seat 14. Thus, seat 14 and lid 16 combinations physically unavailable are labeled as "Not Available" in Table A and Table B. Furthermore, the following undesirable scenarios are labeled as "Prevented" in Table A and Table B. When the seat 14 is opening and the lid 16 is in the opened state, the logic controller 44 prevents the lid 16 from closing to ensure that the seat 14 does not pivot open as the lid 16 pivots closed causing the seat 14 and the lid 16 to collide. Alternatively, when the lid 16 is closing and the seat 14 is in the closed state, the logic controller 44 prevents the seat 14 from opening to ensure that the lid 16 does not pivot closed as the seat 14 pivots open. Lastly, it is of note that switching both switches 158, 162 of the example embodiment simultaneously will cause no change in the state of the bowl attachments. The logic controller 44 may be configured to de-energize both motors 47, 48 in response to both switches 158, 162 being actuated simultaneously.

Turning first to Table A, the logic of the first switch 158 is depicted:

TABLE A

First Switch 158 Program Logic

| First Switch | Seat Opened | Seat Closed | Seat Opening | Seat Closing |
|---|---|---|---|---|
| Lid Opened | Close Both | Open Seat | Close Seat | Close Both |
| Lid Closed | Not Available | Open Both | Not Available | Not Available |
| Lid Opening | Not Available | Open Both | Close Both | Prevented |
| Lid Closing | Not Available | Open Both | Prevented | Open Both |

With reference to Table A, the operation of the logic controller 44 upon toggling the first switch 158 is straightforwardly described. Looking specifically at the first column labeled "Seat Opened," when the seat 14 is opened, switching the first switch 158 when the lid 16 is opened will result in the logic controller 44 energizing the seat motor 47 and lid motor 48 to close both the seat 14 and the lid 16 simultaneously. Thus, the bowl attachments will be pivoted into the closed position.

Moving to the second column labeled "Seat Closed," when the seat 14 is closed and the lid 16 is opened, switching the first switch 158 results in the seat 14 being opened. When the seat 14 is closed and the lid 16 is either closed, opening, or closing, actuating the first switch 158 results in both the seat 14 and the lid 16 opening simultaneously, thus allowing access to the toilet bowl 26.

Referencing the third column labeled "Seat Opening," when the seat 14 is in the process of opening and the lid 16 is opened, toggling the first switch 158 results in the seat 14 closing. When the seat 14 is opening and the lid 16 is opening, switching the first switch 158 results in both the seat 14 and lid 16 being closed by the logic controller 44.

Finally, referring to the column labeled "Seat Closing," when the seat 14 is closing and the lid 16 is opened, toggling the first switch 158 results in both the seat 14 and lid 16 closing. When the seat 14 is closing and the lid 16 is closing, actuating the first switch 158 results in both the seat 14 and lid opening.

Turning next to Table B, the logic of the second switch 162 is depicted:

TABLE B

Second Switch 162 Program Logic

| Second Switch | Seat Opened | Seat Closed | Seat Opening | Seat Closing |
|---|---|---|---|---|
| Lid Opened | Close Seat | Close Lid | Close Both | Open Seat |
| Lid Closed | Not Available | Open Lid | Not Available | Not Available |
| Lid Opening | Not Available | Close Lid | Open Lid/ Close Seat | Prevented |
| Lid Closing | Not Available | Open lid | Prevented | Open Lid/ Close Seat |

With reference to Table B, the operation of the logic controller 44 upon toggling the second switch 162 is plainly described. Looking specifically at the first column labeled "Seat Opened," when the seat 14 and the lid are in the opened state, switching the second switch 162 results in the seat 14 closing. The balance of the first column combinations is not physically available in the example embodiment.

Moving to the second column labeled "Seat Closed," when the seat 14 is closed and the lid 16 is either opened or opening, actuating the second switch 162 results in the lid 16 being closed by the logic controller 44. When the seat 14 is closed and the lid 16 is closed or closing, toggling the second switch 162 results in the lid 16 opening.

With reference to the column labeled "Seat Opening," when the seat 14 is opening and the lid 16 is opened, activating the second switch 162 results in both the seat 14 and lid 16 being closed. When the seat 14 and the lid 16 are opening, actuating the second switch 162 results in the lid 16 continuing to open, but the seat 14 reverses its pivot direction and closes. Again, the seat 14 and lid 16 are prevented from colliding with one another by the logic controller 44.

Finally, referring to the column labeled "Seat Closing," when the seat 14 is closing and the lid 16 is opened, switching the second switch 162 results in the seat 14 opening. When the seat 14 and the lid 16 are in the process of closing, switching the second switch 162 results in the lid 16 reversing its pivotal direction so as to open and the seat 14 continuing to close.

The logic controller 44 is preferably configured to provide additional functions to the attachment assembly 10, including those previously discussed, i.e., the automatic flush switch 32A, a bowl light switch 32B, automated attachment switch 32C, and bowl attachment heater switch 32D. The automatic flush period of delay may be altered by the user and may be configured to flush the toilet 20 at various intervals. For example, the logic controller 44 may be configured to automatically flush the toilet 20 immediately upon closing the seat 14 and the lid 16, or the logic controller 44 may be programmed to vary the automatic flush delay depending upon the time of day or frequency of use. Additionally, the logic controller 44 may be configured to automatically switch on the bowl light depending upon the time or based upon feedback from a light sensor. Furthermore, the logic controller 44 may be programmed to automatically switch on the bowl attachment heaters 116, 122 if the temperature sensed by the thermistors 136, 148 falls below a minimum temperature. As a final non-exhaustive example, the logic controller 44 may be programmed to close either the seat 14 and/or lid 16 after a predetermined period, thus "resetting" the bowl attachments to a "preferred" orientation. Many other logic controller 44 functions are available and within the scope of the present invention.

It should be appreciated that merely example embodiments of the invention have been described above. However, many modifications and variations to the example embodiments will be apparent to those skilled in the art, which will be within the spirit and scope of the invention. Therefore, the invention should not be limited to the described embodiments. To ascertain the full scope of the invention, the following claims should be referenced.

We claim:

1. A toilet seat assembly, comprising:

a bowl attachment configured to be coupled to a toilet and pivot relative to a bowl of the toilet;

a logic controller;

one or more motors that are operable to pivot the bowl attachment, the logic controller controlling whether the one or more motors pivot the bowl attachment; and one or more magnetic sensors operationally coupled to the logic controller for determining at least one of positioning of the bowl attachment and rotational direction of the bowl attachment;

wherein the logic controller determines at least one of positioning of the bowl attachment or rotational direction of the bowl attachment by counting pulses from the one or more magnetic sensors; and wherein the logic controller determines relative locations of a first rotational extreme and a second rotational extreme of the bowl attachment by counting pulses from the one or more magnetic sensors, and the logic controller stops the one or more motors from pivoting the bowl attachment prior to motor current exceeding an appreciable level when the bowl attachment reaches the first and second rotational extremes.

2. The toilet seat assembly of claim 1, further comprising a capacitive sensor having a conductive element coupled to the bowl attachment;

wherein the logic controller is operationally coupled to the capacitive sensor to monitor capacitance of the capacitive sensor, and if increased capacitance is detected due to an object being located adjacent the bowl attachment, the logic controller prevents the one or more motors from pivoting the bowl attachment.

3. The toilet seat assembly of claim 1, further comprising one or more magnets that move about an axis as the bowl attachment is pivoted; and wherein the logic controller and magnetic sensors are cooperatively arranged to monitor movement of the one or more magnets.

4. The toilet seat assembly of claim 2, wherein the one or more magnetic sensors are Hall effect sensors.

5. The toilet seat assembly of claim 1, wherein the one or more magnetic sensors are each a Hall effect sensor, the logic controller and the Hall effect sensor are cooperatively configured to determine the rotational direction of the bowl attachment, and the logic controller causes the one or more motors to pivot the bowl attachment in the rotational direction.

6. The toilet seat assembly of claim 1, wherein the logic controller stops the one or more motors by de-energizing the one or more motors when the logic controller determines according to the counted pulses that the bowl attachment has reached one of the first and second rotational extremes.

7. The toilet seat assembly of claim 6, wherein the logic controller de-energizes the one or motors before the motor current can exceed an appreciable level from the bowl attachment bearing against a rotational stop at one of the first and the second rotational extremes.

8. The toilet seat assembly of claim 1, further comprising:

a capacitive sensor having a conductive element coupled to the bowl attachment, the logic controller being operationally coupled to the capacitive sensor;

wherein the bowl attachment is a toilet seat and the logic controller monitors capacitance of the capacitive sensor and controls movement of the toilet seat in response to the monitored capacitance.

9. The toilet seat assembly of claim 8, wherein the logic controller monitors capacitance of the capacitive sensor to determine whether an object is present or absent adjacent the bowl attachment.

10. The toilet seat assembly of claim 8, wherein if increased capacitance is detected due to an object being located adjacent the bowl attachment, the logic controller prevents the one or more motors from pivoting the bowl attachment.

11. The toilet seat assembly of claim 10, wherein the toilet seat assembly further comprises a lid configured to pivot relative to the bowl of the toilet, and the logic controller controls whether the one or more motors pivot the lid; and wherein if increased capacitance is detected due to an object being located adjacent the seat, the logic controller prevents the one or more motors from pivoting the seat and prevents the one or more motors from pivoting the lid.

12. The toilet seat assembly of claim 11, further comprising a second capacitive sensor having a second conductive element coupled to the lid;

wherein the logic controller monitors capacitance of the second capacitive sensor, and if increased capacitance is detected due to an objected being located adjacent the lid, the logic controller prevents the one or more motors from pivoting the seat and prevents the one or more motors from pivoting the lid.

13. The toilet seat assembly of claim 12, wherein the second conductive element is a foil element.

14. The toilet seat assembly of claim 10, further comprising a switch operationally coupled to the logic controller and configured to receive user input for actuating the one or more motors to pivot bowl attachment;

wherein if increased capacitance is detected, the logic controller prevents the one or more motors from pivoting the bowl attachment regardless of whether the switch receives user input.

15. The toilet seat assembly of claim 8, wherein if increased capacitance is detected due to an object located adjacent the bowl attachment, the logic controller sends a signal to a second logic controller that is separate from the toilet seat assembly.

16. The toilet seat assembly of claim 15, wherein the signal sent by the logic controller indicates when a toilet is in use to the second logic controller, and the second logic controller displays a status of the toilet.

17. The toilet seat assembly of claim 8, wherein the bowl attachment is a seat, the toilet seat assembly further comprises a heater, and the conductive element of the capacitive sensor is a heating element of the heater.

18. The toilet seat assembly of claim 8, wherein the conductive element is a foil element sandwiched between upper and lower portions of the bowl attachment.

19. The toilet seat assembly of claim 8, wherein the conductive element is a sprayed-on electrically conductive coating on the bowl attachment.

20. The toilet seat assembly of claim 8, wherein the bowl attachment is made of an electrically conductive material that forms the conductive element.

* * * * *